United States Patent [19]

Fujishima et al.

[11] 4,352,000

[45] Sep. 28, 1982

[54] INDUCTION HEATING COOKING APPARATUS

[75] Inventors: Kunihiro Fujishima, Moriyama; Takaki Kuramoto, Kyoto, both of Japan

[73] Assignee: Sanyo Electric Co., Ltd., Moriguchi, Japan

[21] Appl. No.: 173,469

[22] Filed: Jul. 29, 1980

[30] Foreign Application Priority Data

Aug. 10, 1979 [JP] Japan ..... 54/102453
Oct. 25, 1979 [JP] Japan ..... 54-148679[U]

[51] Int. Cl.[3] ..... H05B 5/04

[52] U.S. Cl. ..... 219/10.77; 219/10.49 R; 363/96; 363/79; 363/80

[58] Field of Search ..... 219/10.49 R, 10.77; 363/96, 95, 19, 37, 79, 86, 80, 97, 135; 307/252 VA, 252 H, 252 K

[56] References Cited

U.S. PATENT DOCUMENTS

| | | | |
|---|---|---|---|
| 4,016,392 | 4/1977 | Kobayashi et al. | 219/10.77 |
| 4,112,286 | 9/1978 | Alderman et al. | 219/10.77 |
| 4,112,287 | 9/1978 | Oates et al. | 219/10.77 |
| 4,115,676 | 9/1978 | Higuchi et al. | 219/10.77 |
| 4,275,281 | 6/1981 | Kiuchi | 219/10.77 |

*Primary Examiner*—B. A. Reynolds

*Assistant Examiner*—M. H. Paschall

*Attorney, Agent, or Firm*—Darby & Darby

[57] ABSTRACT

An induction heating cooking apparatus comprises a self-controlled inverter which comprises a series connection of an induction coil and a switching element, a resonance capacitor connected in parallel with the switching element, and a flywheel diode. An inverter driver circuit triggers the inverter with a starting pulse obtained from a starting signal generator. A voltage signal associated with a current flowing through the switching element is obtained by means of a current transformer. A voltage source of the inverter is implemented as a ripple current voltage source. A comparator of a gate signal generator compares a reference level changing in accordance with the ripple current voltage and the voltage detected by the current transformer, thereby rendering the switching element non-conductive when the voltage level reaches the reference level. A load detecting circuit detects a ratio of the conduction period of the flywheel diode with respect to the oscillation cycle of the inverter, thereby detecting a proper or improper state of a load placed on the top plate in accordance with the above described ratio. The oscillation of the inverter is stopped upon detection of the improper state of the load by means of the load detecting circuit.

38 Claims, 14 Drawing Figures

INDUCTION HEATING COOKING APPARATUS

BACKGROUND OF THE INVENTION

1. Field of the Invention

The present invention relates to an induction heating cooking apparatus. More specifically, the present invention relates to an induction heating cooking apparatus employing such an element as a transistor, a gate turn-off thyristor or the like as a switching element for a self-controlled inverter.

2. Description of the Prior Art

An induction heating cooking apparatus is provided with a ripple current voltage obtained by rectifying the commercial alternating current source voltage or a direct current voltage obtained by smoothing the above described ripple current voltage. An inverter is energized by the ripple current voltage or the direct voltage, so that the inverter makes a high frequency oscillation of about 20 to 40 kHz. The inverter is implemented with an induction heating coil, so that a high frequency alternating magnetic field is generated by the induction heating coil in accordance with the high frequency oscillation of the inverter. A cooking pan made of an iron group metal, such as iron, stainless steel, or the like, disposed in the vicinity of the induction heating coil is induction heated by the high frequency alternating magnetic field. An example of such an induction heating cooking apparatus is disclosed in, for example, U.S. Pat. No. 3,781,503, issued Dec. 26, 1973 to Harnden, Jr. et al. and entitled "SOLID STATE INDUCTION COOKING APPLIANCES AND CIRCUITS". An inverter of such an induction heating cooking apparatus comprises a switching element connected to the induction heating coil. As a switching element, the above referenced U.S. Pat. No. 3,781,503 employs a silicon controlled rectifier. However, in the case where a silicon controlled rectifier is employed as a switching element, it is necessary to separately provide a turning-off circuit for the silicon controlled rectifier, which makes the circuit configuration complicated.

Accordingly, of late it has been proposed that as such a switching element, a switching element for a simple control of conduction or non-conduction, such as a transistor of a relatively large capacity, a gate turn-off thyristor, or the like, be used in place of a silicon controlled rectifier. An inverter employing such a switching element is implemented as a self-controlled oscillation type. A self-controlled oscillation inverter requires a signal for continuing oscillation of the inverter responsive to the output of the inverter after the inverter is once triggered, i.e. control means for controllably rendering the switching device conductive or non-conductive.

An inverter employing such control means as described above is disclosed in, for example, U.S. Pat. No. 4,115,676 issued Sept. 19, 1978 to Higuchi et al. and entitled "INDUCTION HEATING APPARATUS". The above described U.S. Pat. No. 4,115,676 is the prior art of most interest to the present invention. A self-excited inverter of U.S. Pat. No. 4,115,676 comprises an induction coil, a transistor connected in series therewith, a resonance capacitor connected in parallel with the transistor and a flywheel diode. The inverter is energized with a direct current voltage obtained by full-wave rectifying the commercial power supply voltage. A current flowing through the induction coil is detected between the rectifying circuit and the induction coil. More specifically, a coil for detecting a current flowing through the current path of the induction coil is coupled to the rectifying circuit side. The base electrode of the transistor is connected to receive a signal for controlling the transistor to be conductive or non-conductive in accordance with the current detected from the coil. However, such an inverter as disclosed in U.S. Pat. No. 4,115,676, which controls the transistor based on the current flowing through the induction coil, involves a problem to be set forth in the following. More specifically, the current flowing through the induction coil is not necessarily the same as the current flowing through the switching transistor. The current flowing through the transistor is not related to the current flowing through the induction coil, but could involve a surge current, a vibration or the like. In other words, detection of the current flowing through the induction coil does not necessarily result in accurate detection of the current of the transistor caused by such a surge current, a vibration or the like. Accordingly, control of such a transistor based on the current flowing through the induction coil is not sufficient to protect the switching transistor. More specifically, since such a surge current is not detected as a current in the induction coil, even if the surge current flows through the transistor, the transistor can not be effectively prevented from being damaged with such a surge current.

SUMMARY OF THE INVENTION

An induction heating cooking apparatus in accordance with the present invention comprises a self-controlled inverter, which comprises a switching element connected in series with an induction coil, a resonance capacitor connected in parallel with the switching element, and a directional element. A current flowing through the switching element included in such a self-excited or self-controlled inverter is detected. The switching element is controlled to be non-conductive when the current flowing through the switching element (not a current flowing through the induction coil) reaches a predetermined level.

Since the present invention is adapted such that the current flowing through the switching element is detected, whereby the switching element is controlled, such current can be accurately detected and the switching element can be accurately controlled, even if a surge current, a vibration current or the like occurs in the switching element. Therefore, the switching element, such as a transistor, a gate turn-off thyristor or the like, can be fully protected from damage. Accordingly, as compared with the previously referenced U.S. Pat. No. 4,115,676, the latitude of the current capacity of the switching element can be made small and the rating required for the element may also be small, as compared with that used in the previously referenced patent. Accordingly, the inventive apparatus can be manufactured with a more inexpensive cost.

In a preferred embodiment of the present invention, as an energizing voltage source for a self-controlled inverter, a ripple current voltage source is used for the purpose of improving the power factor. Upon detection of the level of the current flowing through the switching element, the same is compared with a reference level changing in accordance with the ripple current voltage source. Therefore, according to the present preferred embodiment of the present invention, an oscillation waveform analogous to the envelope of the source voltage can be obtained, and as a result the oscillation frequency of the inverter can be better stabilized. Such stabilization of the oscillation frequency can prevent the occurrence of an audible noise sound due to a decrease of the oscillation frequency of the inverter.

In another preferred embodiment of the present invention, a protecting circuit is provided for forcibly rendering the switching device non-conductive upon detection of the conduction of the switching device included in the inverter for more than a predetermined time period. According to the preferred embodiment under discussion, even if it could rarely occur that the gate signal generator for controlling the switching element fails to generate a signal for rendering the switching element non-conductive through failure to accurately detect the current flowing through the switching element, the switching element is controlled to be non-conductive forcibly and unconditionally at a predetermined time period after conduction of the switching element. Accordingly, an overcurrent is effectively prevented from flowing through the switching element. Therefore, a prolonged life of the switching element is secured. By thus adapting the inverter to cause necessarily oscillation at a higher frequency at the beginning of operation of the inverter by means of such protecting circuit, the occurrence of an audible sound noise due to a decrease of the oscillation frequency that could have conventionally occurred in a non-load state can be effectively prevented.

In a further preferred embodiment of the present invention, a ratio of the conduction period of the directional element, such as a flywheel diode included in the inverter, with respect to the oscillation cycle of the inverter is detected, whereby the positioning of a load on the top plate of the apparatus is detected. More specifically, if and when the conduction period of the flywheel diode becomes longer by a predetermined amount than the oscillation cycle of the inverter, it is determined that no load has been placed on the top plate at all or, even if a load has been placed, the load is too large or too small. Such detection or determination makes skillful use of the fact that if and when a load is in an improper state, for example in a case of too large a load, such as a copper pan or an aluminum pan, or in case of too small a load, such as a knife, fork or the like, or in case of a no-load, the conduction period of the flywheel diode becomes relatively longer. According to the preferred embodiment under discussion, any type of load condition can be detected by a common detecting circuit, and in particular, no separate circuits need be provided for detecting a too-large load condition, a too-small load condition, or a no-load condition. Accordingly, the overall circuit configuration becomes simple and the apparatus becomes more inexpensive.

In still a further preferred embodiment of the present invention, the conduction period of the switching element is slightly prolonged as compared with a normal case, when the ripple current voltage increases again after the same once reaches the minimum value. According to the preferred embodiment of the present invention under discussion, since the resonance voltage of the inverter becomes assuredly lower than 0 V, unstableness of the oscillation can be completely eliminated.

Accordingly, a general object of the present invention is to provide an improved induction heating cooking apparatus.

Another object of the present invention is to provide an inexpensive induction heating cooking apparatus.

A further object of the present invention is to provide an induction heating cooking apparatus wherein a switching element included in an inverter employed in the apparatus can be assuredly protected.

Still a further object of the present invention is to provide an induction heating cooking apparatus that is capable of detecting any type of load condition by means of a common means.

It is another object of the present invention to provide an induction heating cooking apparatus that effectively prevents the occurrence of an audible sound noise due to an abnormal decrease of the oscillation frequency.

It is a further object of the present invention to provide an induction heating cooking apparatus employing an inverter of stabilized oscillation.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
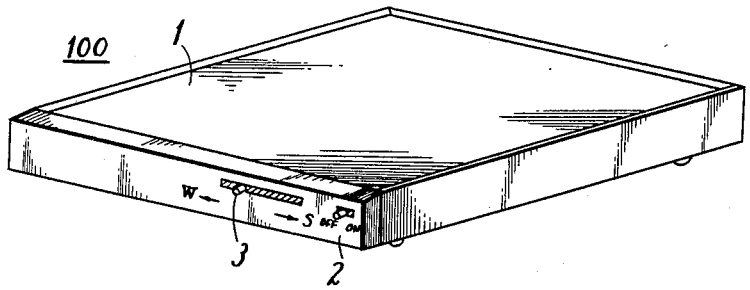
FIG. 1 is an outline perspective view showing one embodiment of the present invention.
Figure 2:
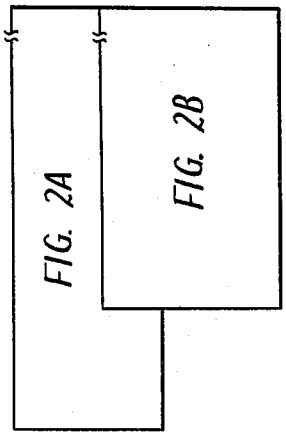
FIG. 2 is a schematic diagram showing one embodiment of the present invention.

FIG. 1 is a perspective view of an induction heating cooking apparatus in accordance with one embodiment of the present invention. The cooking apparatus 100 comprises a top plate 1 provided on the upper surface of a casing or housing. The top plate 1 is made of an insulating material such as ceramic. A spiral induction heating coil is provided within the casing or housing beneath the top plate 1 and close to the top plate 1, although the same is not shown in the figure. A high frequency alternating magnetic field is generated by the induction heating coil, whereby a load, not shown, such as a pan placed on the top plate 1, is heated. A power switch 2 and a power adjusting knob 3 are provided on the front surface of the casing or housing. The output adjusting knob 3 is operatively coupled to a sliding contact of a variable resistor included in the output adjusting circuit 28 to be described subsequently with reference to FIG. 2 for the purpose of varying the resistance value of the variable resistor, whereby the output power of the apparatus can be arbitrarily set in the range from the output power "STRONG" for 1200 W to the output power "WEAK" for 200 W.

Figure 2A:
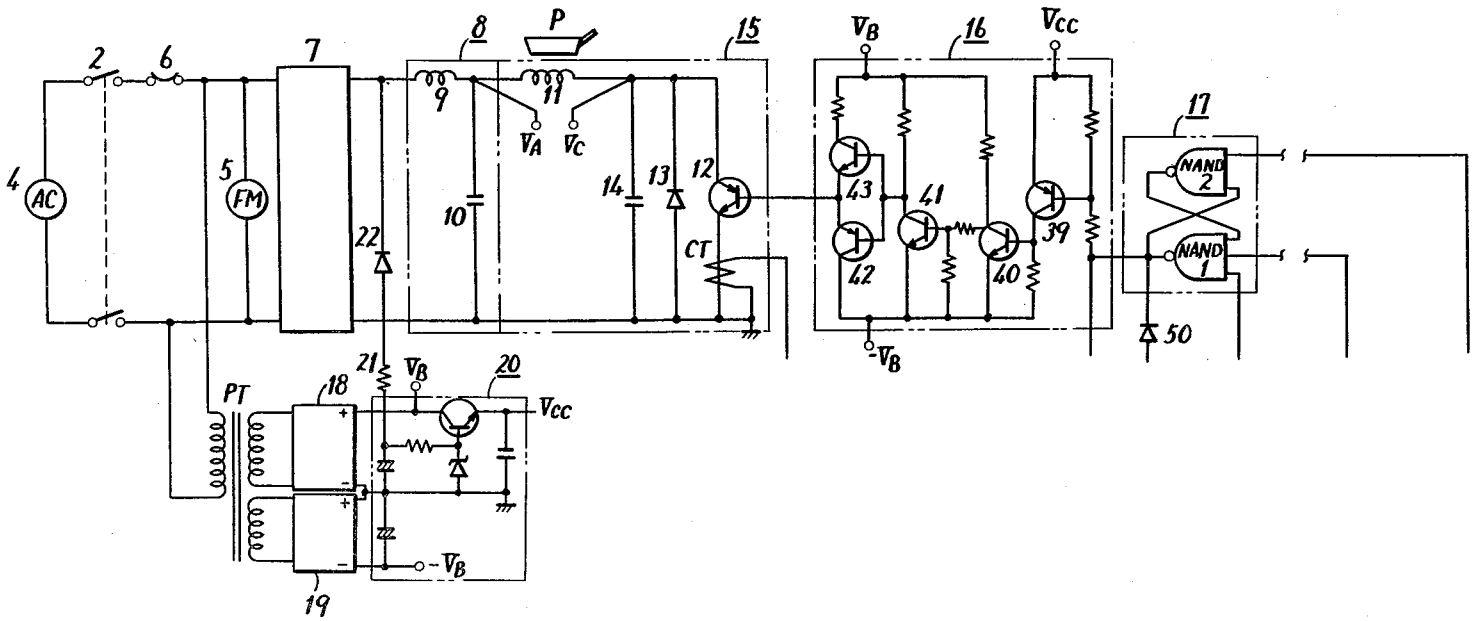
Figure 2B:
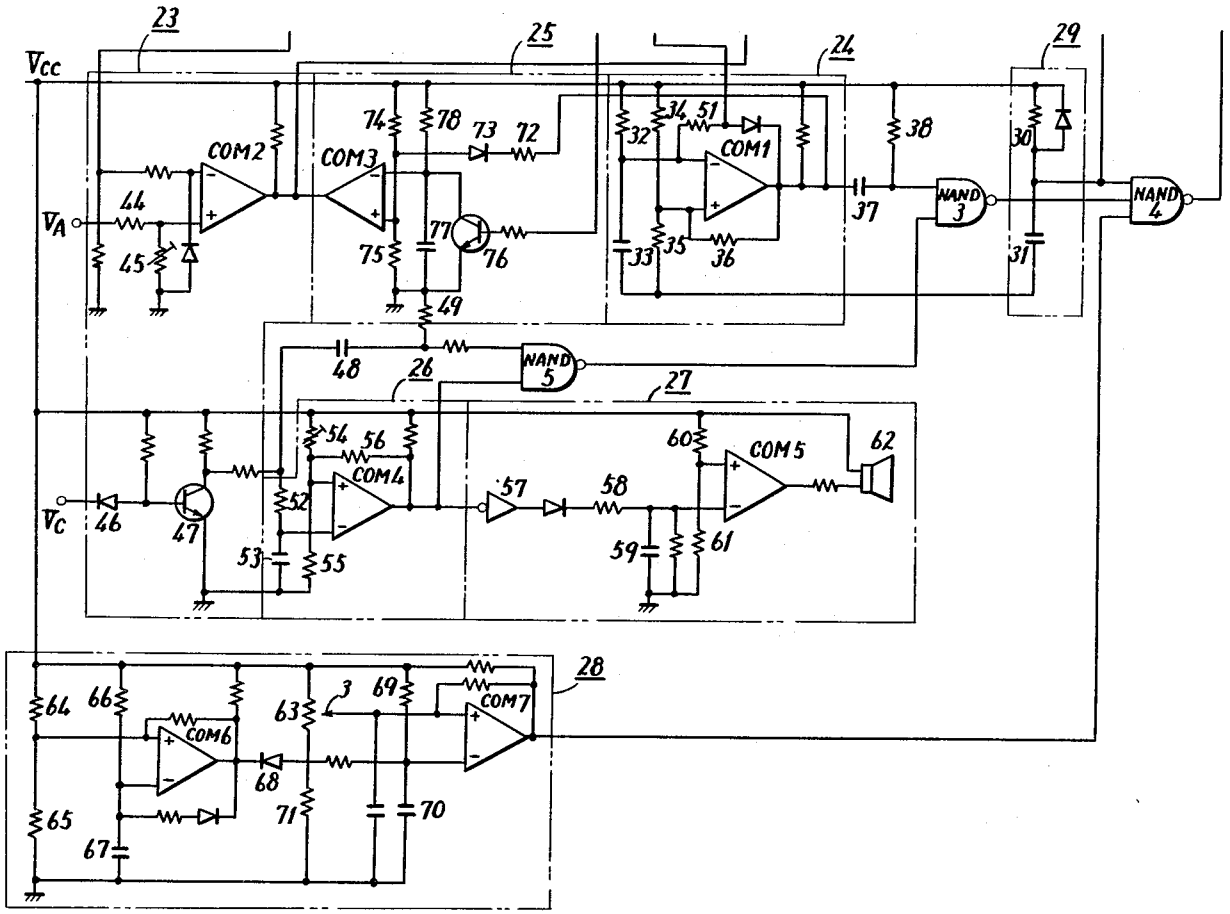

FIGS. 2A and 2B are a schematic diagram of one embodiment of the present invention. A commercial alternating current voltage source 4 is used as a power source for the cooking apparatus. A fan motor 5 and a rectifying circuit 7 are connected through a power switch 2 and a thermostat 6 to the alternating current voltage source 4. The fan motor 5 is used for cooling a switching element 12 to be described subsequently among circuit components constituting the above described circuit. The thermostat 6 is provided to prevent various circuit components from reaching an abnormally high temperature that may cause damage, due to the stoppage of the fan motor 5 or heating in a no-load state. Although not shown, the rectifying circuit 7 comprises a full-wave rectifying circuit implemented by a diode bridge connection. A self-excited or self-controlled inverter 15 is connected through a filter circuit 8 to the rectifying circuit 7. The filter circuit 8 comprises a choke coil 9 and a filter capacitor 10. The self-excited or self-controlled inverter 15 comprises an induction coil 11 connected at one end to the output terminal of the filter circuit 8, and a switching element 12 connected in series with the induction coil 11. The induction coil 11 is provided on the rear surface of and in vicinity of the top plate 1 (FIG. 1), as described previously. The switching element 12 comprises a gate turn-off thyristor (GTO), a transistor or the like. The switching element 12 is shunted with a flywheel diode 13 with an opposite polarity between the anode and cathode of the switching element and is further shunted with a resonance capacitor 14. The inverter 15 is implemented by the induction coil 11, the switching element 12, the flywheel diode 13 and the resonance capacitor 14. Such an inverter 15 is referred to as a self-excited or self-controlled inverter and is adapted such that after the same is triggered by a trigger pulse at the beginning, the oscillation is continued responsive to the output of the oscillation. Meanwhile, a circuit for providing such a trigger pulse, a circuit for providing a signal for continuing the oscillation and the like will be described subsequently.

A cooking pan P is placed on the top plate 1 (FIG. 1) in the vicinity and above the induction coil 11 constituting the inverter 15. The cooking pan P is made of an iron group metal, such as iron, stainless steel or the like, so that the same is induction heated by a high frequency alternating magnetic field generated by the induction coil 11.

The switching element 12 included in the self-controlled inverter 15 is controlled by an inverter driver circuit 16. More specifically, the inverter driver circuit 16 provides a positive or negative ON or OFF signal to the gate electrode of the switching element 12 responsive to the output signal obtained from a NAND gate NAND1 of a flip-flop 17.

A primary winding of a step-down transformer PT is connected through the power switch 2 and the thermostat 6 to the commercial alternating current power supply 4. Rectifying circuits 18 and 19 are connected to two secondary windings of the step-down transfomer PT, respectively. A constant voltage circuit 20 is connected to receive the output voltages of the rectifying circuits 18 and 19. A direct current voltage $\pm V_B$ ($\pm 12$ V) is obtained from the input side of the constant voltage circuit 20 and a stabilized direct current voltage $V_{CC}$ (8 V) is withdrawn from the output side of the constant voltage circuit 20. The direct current voltage $\pm V_B$ is used as a driving voltage source (a biasing voltage source) of the inverter driver circuit 16 and the stabilized direct current $V_{CC}$ is supplied to the respective control circuits being described subsequently as a driving voltage source thereof. The input side of the constant voltage circuit 20 is connected to the input terminal of the filter circuit 8 through a series connection of a resistor 21 and a diode 22. More specifically, it follows that the direct current voltage $+V_B$ is superimposed on the output voltage of the rectifying circuit 7 and accordingly the source voltage of the inverter 15 is prevented from becoming lower than $+V_B$. Accordingly, the minimum value of the source voltage of the inverter 15 can be maintained at approximately $+V_B$. More specifically, a capacitor 10 included in the filter circuit 8 in the embodiment shown is selected to be of a relatively small capacitance for the purpose of improving the power factor in the inverter 15. Therefore, the source voltage of the inverter 15 is obtained as a ripple current voltage which has not been smoothed. Therefore, at the time when the source voltage becomes the minimum, the source voltage would be smaller than approximately 10 V and there is a fear that oscillation of the inverter 15 can not be continued with such a low voltage. Therefore, the direct current voltage $+V_B$ is also supplied as an auxiliary voltage source so as not to interrupt the oscillation of the inverter 15.

The direct current voltage $V_{CC}$ obtained from the constant voltage circuit 20 as converted to a constant voltage is applied as a voltage source of a gate signal generator 23 (FIG. 2B). The gate signal generator 23 is used to provided an ON/OFF signal (a forward bias/a reverse bias) to the gate electrode of the switching element 12 included in the self-controlled inverter 15. More specifically, the circuit 23 detects the voltage $V_C$ of the induction coil 11 at the side of the switching element 12 by means of a diode 46 and a transistor 47 once the inverter 15 is started with a start signal at the beginning of operations, whereupon the flip-flop 17 is set responsive to the detected output, whereby a gate signal is provided to the switching element 12 through the inverter driver circuit 16.

A current transformer CT is coupled to the path of current flowing through the switching element 12 included in the self-controlled inverter 15. Accordingly, a voltage $V_{CT}$ having the level associated with the level of the current flowing through the switching element 12 is obtained from the current transformer CT. The gate signal generator 23 comprises a comparator COM2 connected to receive the output voltage $V_{CT}$ of the current transformer CT and the voltage $V_A$ at the input side of the induction coil 11. The comparator COM2 uses the voltage $V_A$ as a reference level. Accordingly, the comparator COM2 provides the low level output, thereby to reset the flip-flop 17, if and when the following condition is met:

$$V_{CT} \geqq \frac{V_A \cdot R45}{R44 + R45}$$

where R44 and R45 are resistance values of the resistors 44 and 45, respectively.

The stabilized direct current voltage $V_{CC}$ from the constant voltage circuit 20 is applied as a source voltage for the start signal generator 24. The start signal generator 24 provides the first starting pulse to the self-controlled inverter 15 and generates a starting pulse at a predetermined cycle $\tau$, (say 0.4 seconds). The cycle ($\tau$) of the starting pulse obtained from the start signal generator 24 can be arbitrarily set; however, it is not preferred that initiation of the oscillation of the inverter 15 be too much delayed after the turning on of the power supply and accordingly from the practical standpoint such cycle ($\tau$) is selected to be smaller than approximately one second. The start signal generator 24 comprises a comparator COM1. One input of the comparator COM1 is connected to the junction of a series connection of a resistor 32 and a capacitor 33, and the other input is connected to the junction of a series connection of resistors 34 and 35. The resistors 32 and 34 are connected to the line of the source voltage $V_{CC}$. Accordingly, one input of the comparator COM1 is supplied with an integrated voltage signal increasing in accordance with the time constant of the resistor 32 and the capacitor 33, and the other input of the comparator COM1 is provided with a constant voltage obtained by dividing the source voltage $V_{CC}$ by means of the resistors 34 and 35. Furthermore, a series connection of a resistor 51 and a diode is connected between one input and output of the comparator COM1, and a resistor 36 is connected between the other input and the output of the comparator COM1. A diode 50 is connected between the junction of the resistor 51 and the diode and the output point of the NAND gate NAND1 constituting the flip-flop 17. The comparator COM1 provides the low level output if and when the voltage being applied to one input, i.e. the voltage of the capacitor 33 becomes larger than the reference voltage V+ being applied to the other input. Meanwhile, the diode 50 inserted between the circuit 24 and the flip-flop 17 is used to clamp the capacitor 33 connected to the input of the comparator COM1 to the low voltage when the output of the flip-flop 17 repeats the low level and the high level.

The output of the comparator COM1 is connected to one input of NAND gate NAND3 through a differentiating capacitor 37. One input of the NAND gate NAND3 is connected to the line of the source voltage $V_{CC}$ through the resistor 38. The resistor 38 is used to narrow the width of the output pulse of the comparator COM1 to provide a pulse of a narrow width (say 6 to 7$\mu$ seconds) when the output of the comparator COM1 is relatively wide (say 20 millisec). The other input of the NAND gate NAND3 is provided with the output of a NAND gate NAND5 to be described subsequently. The output of the NAND gate NAND3 is applied to one input of a three-inputted NAND gate NAND4. Another input of the NAND gate NAND4 is supplied with the output of an initial clear circuit 29 and the remaining input of the NAND4 is supplied with the output of the output adjusting circuit 28. The initial clear circuit 29 forcibly turns to the high level the output of the NAND gate NAND4 if and when the power supply is turned on and it comprises a series connection of a resistor 30 and a capacitor 31.

A stabilized direct current voltage $V_{CC}$ obtained from the constant voltage circuit 20 is further applied to the protecting circuit 25. The protecting circuit 25 comprises a comparator COM3 and unconditionally renders the switching element 12 non-conductive if and when a predetermined time period passes after the switching element 12 constituting the inverter 15 is rendered conductive, whereby the switching element 12 is prevented from being damaged due to an overcurrent. The protecting circuit 25 also prevents the oscillation frequency of the inverter 15 from being decreased to an audible frequency range. The reference level input of the above described comparator COM3 is connected to the junction of a series connection of resistors 74 and 75 and the other input of the above described comparator COM3 is connected to the junction of the series connection of resistor 78 and the capacitor 77. Accordingly, the comparator COM3 provides the low level output after a predetermined time period associated with the time constant determined by the resistor 78 and the capacitor 77. The output of the comparator COM3 and the output of the previously described comparator COM2 are applied to the inputs of the NAND gate NAND1 of the flip-flop 17. The collector and emitter electrodes of the transistor 76 are connected to both ends of the capacitor 77 and the base electrode of the transistor 76 is connected through a resistor to the output of the NAND gate NAND1 of the flip-flop 17. The junction of the resistors 74 and 75 is connected through a series connection of a diode 73 and a resistor 72 to the output of the previously described comparator COM1.

The load detecting circuit 26 detects whether a load or a cooking pan P is suited for induction heating or whether such load has been placed on the cooking apparatus. The load detecting circuit 26 detects an improper load, for example, too large a load, such as a copper pan, aluminum pan or the like, or conversely too small a load such as a knife, fork or the like, whereupon the oscillation of the inverter 15 is stopped when such improper load is placed on the top plate 1 (FIG. 1). The load detecting circuit 26 comprises a comparator COM4. The reference level input of the comparator COM4 is connected to the junction of a series connection of a variable resistor 54 and a resistor 55, and the other input of the comparator COM4 is connected to the junction of a series connection of the resistor 52 and the capacitor 53. The other end of the resistor 52 is connected to one input of a NAND gate NAND5 through the capacitor 48 and a resistor. Meanwhile, the junction of the series connection of the capacitor 48 and the resistor is connected to ground through a resistor 49. A resistor 56 is connected between the reference level input and the output of the comparator COM4 and the output thereof is applied to the other input of the previously described NAND gate NAND5. The output of the NAND gate NAND5 is applied to the other input of the previously described NAND gate NAND3.

The output of the comparator COM4 included in the load detecting circuit 26 is applied to the input of an alarm generating circuit 27. The alarm generating circuit 27 is adapted to generate a buzzer sound intermittently if and when the load is determined as improper by the load detecting circuit 27, whereby an operator is notified of such an improper load condition. The alarm generating circuit 27 comprises a comparator COM5, the reference level input of which is supplied with the voltage at the junction of a series connection of resistors 60 and 61. The output of the inverter 57 receiving the output of the comparator COM4 is applied to the other input of the comparator COM5 through a diode and a resistor 58. A capacitor 59 is connected between the other input of the comparator COM5 and the ground. The output of the comparator COM5 is obtained as a driver voltage of the buzzer 62.

The direct current source voltage $V_{CC}$ obtained from the constant voltage circuit 20 is also used as a voltage source for the output adjusting circuit 28. The output adjusting circuit 28 comprises comparators COM6 and COM7. The reference level input of the comparator COM7 is connected to receive the voltage of the variable resistor 63 having the sliding contact thereof connected to the output adjusting knob 3 (FIG. 1). The other input of the comparator COM7 is connected to receive the output voltage of an integrating circuit implemented by a resistor 69 and a capacitor 70. The junction of the resistor 69 and the capacitor 70 constituting the integrating circuit is connected through a diode 68 and a resistor to the output of the comparator COM6. The reference level input of the comparator COM6 is connected to receive the voltage at the junction of a series connection of resistors 64 and 65, and the other input of the comparator COM6 is connected to receive the voltage at the junction of a series connection of a resistor 66 and a capacitor 67. The output adjusting circuit 28 is adapted to change the duty cycle of the inverter 15 between approximately 16% and 100% for the purpose of adjusting the output power in the range from approximately 200 to 1200 W. Such a change of the duty cycle and thus the output power can be made by changing the resistance value of the variable resistor 63 connected in seies with the resistor 71 by operating the operation knob 3 (FIG. 1). Now that the structural features have been described in the foregoing, the respective operations will be described in detail in the following with reference to the associated waveforms.

Figure 3:
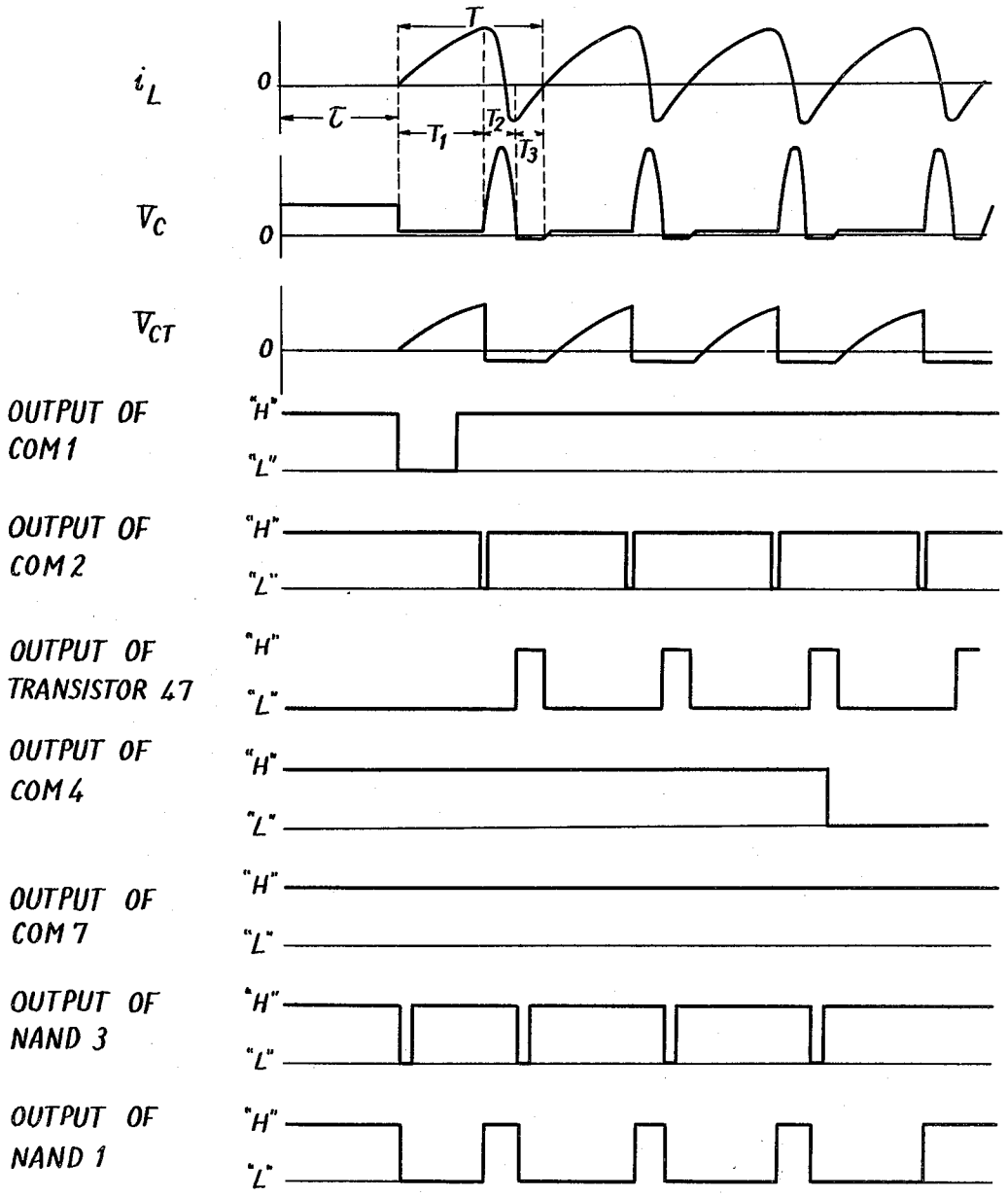
FIG. 3 is a graph showing waveforms at various portions in the embodiment shown in FIGS. 1 and 2 for explaining a normal heating operation.

I. Normal Heating Operation (See FIG. 3.)

A proper load P is placed on the top plate (FIG. 1) and the power supply switch 2 is turned on. Then the initial clear circuit 29 is operable, so that the low level signal is applied to the input of the NAND and NAND1 constituting the flip-flop 17 for a time period associated with the time constant of the resistor 30 and the capacitor 31. Accordingly, the output of the NAND gate NAND1 becomes the high level. In such a state, the start signal generator 24 implemented by an unstable oscillator starts an operation. More specifically, the minus input of the comparator COM1 included in the start signal generator 24 is supplied with the output voltage of the time constant circuit comprising the resistor 32 and the capacitor 33. On the other hand, the other input, i.e. the reference level input of the comparator COM1 is supplied with the reference voltage V+ obtained by dividing the direct current voltage $V_{CC}$ (8 V) by means of the resistors 34, 35 and 36. Accordingly, after the lapse of a predetermined time period $\tau$ (say 0.4 seconds) determined by the above described time constant, from the turning on of the power supply switch 2, the charging voltage of the capacitor 33 reaches the level of the reference voltage V+. Accordingly, the output of the comparator COM1 turns from the high level to the low level. The fall to the low level of the output of the comparator COM1 is differentiated by the differentiating circuit implemented by the capacitor 37 and the resistor 38 and the differentiated output is obtained as the low level pulse. The output of the differentiating circuit is applied to the NAND gate NAND3. The other input of the NAND gate NAND3 is supplied with the high level at that time and therefore the output of the NAND gate NAND3 turns to the high level in response to the low level pulse from the differentiating circuit. Since two other inputs of the NAND gate NAND4 are also at the high level, the low level pulse is obtained from the output of the NAND gate NAND4 responsive to the output of the NAND gate NAND3. Accordingly, the flip-flop 17 is reversed from the storing state and the output of the NAND gate NAND1 becomes the low level. When the output of the NAND gate NAND1 becomes the low level, the transistors 39 and 40 included in the inverter driver circuit 16 are both rendered conductive and the transistors 41 and 42 are both rendered non-conductive, while the transistor 43 is rendered conductive. Accordingly, the gate electrode of the switching element 12, such as a gate turn-off thyristor included in the inverter 15, is supplied with a forward bias voltage $+V_B$, whereby the switching element 12 is rendered conductive. Thus, the oscillating operation of the inverter 15 is initiated.

The oscillating operation of the inverter 15 thereafter will be further described. First, a load current $i_L$ flows through the induction coil 11 and the switching element 12 through conduction of the switching element 12. The load current $i_L$ is detected by means of the current transformer CT as a current flowing through the switching element 12 and is converted into a voltage signal $V_{CT}$ in proportion to the magnitude of the load current $i_L$. The voltage signal $V_{CT}$ is applied to the minus input of the comparator COM2 included in the gate signal generator 23. The plus input, i.e. the reference level V+ of the comparator COM2 is supplied with the output of the filter circuit 8, i.e. the voltage obtained by dividing the source voltage $V_A$ by means of the resistors 44 and 45. Accordingly, the reference input voltage V+ of the comparator COM2 changes in association with the source $V_A$. The peak current of the switching element 12 is determined by the reference level V+.

Now the reference level V+ of the comparator COM2 will be described. In the embodiment shown, as the source voltage being applied to the inverter 15, a ripple current voltage changing in the range from a maximum of 150 V to a mimimum of approximately 12 V is used. The reason is that the capacitor 10 is selected have a relatively small capacitance for the purpose of improving the power factor, which low capacitance smooth the output of the rectifying circuit 7 very much. Accordingly, the level of the load current detected by the current transformer CT, i.e. the level of the current flowing through the element 12 also changes. Therefore, assuming that the reference level V+ is set to be the maximum value of the source voltage in a fixed manner, then the voltage $V_{CT}$ from the current transformer CT decreases as the source voltage decreases and the difference between the same and the reference level V+ becomes extremely large. As a result, when the source voltage thus decreases, the cycle in which the low level output is obtained from the comparator COM2 becomes extremely long. Accordingly, the oscillation frequency of the inverter 15 becomes much lower, as low as several kHz, and therefore an audible sound noise is caused by the inverter 15, which noise degrades the quality of the apparatus. More specifically, the load current $i_L$ may be expressed by the following equation:

$$i_L = \frac{V_A}{R}\left\{1 - \exp\left(-\frac{R}{L}t\right)\right\}$$

In the above described equation L represents the equivalent inductance of the induction coil 11 and R represents an equivalent resistance. Referring to the above described equation, the time period $T_1$ when the load current $i_L$ reaches the peak value $I_P$ may be expressed by the following equation:

$$T_1 = \frac{L}{R}\ln\left(\frac{V_A}{V_A - RI_P}\right)$$

Referring to the above described equation, assuming that the equivalent inductance L, the equivalent resistance R and the peak value of the load current $i_L$ are constant, the time period $T_1$ is solely dependent on the source voltage $V_A$. Therefore, it follows that a current which has undergone frequency modulation in accordance with the ripple current source voltage $V_A$ flows in the induction coil 11. In order to prevent such phenomenon, the embodiment shown is adapted such that the oscillation frequency of the inverter 15 may be stabilized by changing the reference level V+ of the comparator COM2 in proportion to the source voltage $V_A$, as described above.

If and when the voltage $V_{CT}$ being applied to the minus input of the comparator COM2 increases to reach the reference level V+, the output of the comparator COM2 turns from the high level to the low level. Accordingly, the output of the NAND gate NAND1 of the flip-flop 17 becomes the high level. Accordingly, the transistors 39 and 40 included in the inverter driver circuit 16 are rendered non-conductive while the transistor 41 is rendered conductive, the transistor 43 is rendered non-conductive and the transistor 42 is rendered conductive. Accordingly, the gate electrode of the switching element 12 included in the inverter 15 is supplied with the reverse bias $-V_B$ and the switching element 12 is rendered non-conductive. The conduction period of the switching element 12 is assumed to be $T_1$.

Upon turning off of the switching element 12, a charging operation of the resonance capacitor 14 is started by the electromagnetic energy stored in the induction coil 11. Upon completion of the discharge by the electromagnetic energy, a discharge operation of the resonance capacitor then starts. The charging/discharging period of the resonance capacitor 14 is assumed to be $T_2$.

When the discharge of the resonance capacitor 14 is completed, the electromagnetic energy stored in the induction coil 11 by the discharge in the direction opposite to the previous one is discharged through the flywheel diode 13. The conduction period of the flywheel diode 13 is assumed to be $T_3$. Meanwhile, since the reverse bias voltage $V_C$ corresponding to the forward directional ON voltage of the flywheel diode 13 has been applied between the anode and cathode of the switching element 12 during the conduction period $T_3$, the switching element 12 will not be rendered conductive even if the positive voltage is applied to the gate electrode of the switching element 12.

On the other hand, the terminal voltage $V_C$ of the resonance capacitor 14 is applied to the gate signal generator 23. More specifically, the voltage $V_C$ is applied to the base electrode of the transistor 47 through the diode 46. Accordingly, the transistor 47 is rendered non-conductive during the above described period $T_3$. Therefore, the collector electrode of the transistor 47 becomes the high level during the period $T_3$. The rise of the high level of the collector voltage is differentiated by the differentiating circuit implemented by the capacitor 48 and the resistor 49 to provide a high level pulse, which is applied to the NAND gate NAND5. Since the other input of the NAND gate NAND5 is at the high level at that time, a low level pulse is obtained from the output of the NAND gate NAND5 and the same is applied to the NAND gate NAND3 of the subsequent stage. Since the other input of the NAND gate NAND3 is also at high level at that time, a high level pulse is obtained from the output of the NAND gate NAND3 and the same is further applied to the NAND gate NAND4. Since the other two inputs of the NAND gate NAND4 are both the high level at that time, a low level pulse is obtained from the output of the NAND gate NAND4 and accordingly the flip-flop 17 is set. Accordingly, the output of the NAND gate NAND1 included in the flip-flop 17 changes to the low level. As the output of the NAND gate NAND1 becomes the low level, the transistors 39 and 40 included in the inverter driver circuit 16 are again rendered conductive, the transistor 41 is rendered non-conductive, the transistor 43 is rendered conductive and the transistor 42 is rendered non-conductive. Accordingly, the gate electrode of the switching element 12 of the inverter 15 is again supplied with the forward directional bias voltage $+V_B$. The above described operation is performed at the beginning of the conduction period $T_3$ of the above described flywheel diode 13 and such state is maintained during that period $T_3$ and the subsequent period $T_1$. Therefore, at the same time as the discharge of the electromagnetic energy of the induction coil 11 through the flywheel diode 13 is ended and the voltage $V_{CC}$ turns to be positive, and the switching element 12 is rendered conductive. Accordingly, the load current $i_L$ again flows through the switching element 12 and the next cycle of the self-controlled oscillation of the inverter 15 begins. After the oscillation responsive to the start pulse obtained from the start signal generator 24 thus started, the inverter 15 makes self-controlled oscillations at the frequency of approximately 20 to 40 kHz in association with the load condition, i.e. the condition of the pan P. In such self-controlled oscillating state, the output of the NAND gate NAND1 repeats the high level or the low level in association with the oscillation frequency, while the low level signal is clamped to the level lower than the minus input of the comparator COM1 through the diode 50 and the resistor 51. Therefore, the output of the comparator COM1 is also clamped to the high level and the start pulse will not be generated again from the start signal generator 24.

II. Load Detecting Operation (See FIGS. 4 and 5.)

In general, in an induction heating cooking apparatus, a continued heating operation in an improper load condition entails the following problems. More specifically, in case of too large a load, an overcurrent flows through the inverter and the switching element is damaged. On the other hand, if and when a heating operation is erroneously continued while too small a load such as a knife, fork or the like is placed on the top plate 1 (FIG. 1), there is a fear that an operator will be burnt when he touches the heated knife, fork or the like, unless the operator is notified of the same. Furthermore, in a no-load state, i.e. in the case where no load is placed on the top plate 1, the heating operation causes an overvoltage in the inverter which damages the switching element or wastefully consumes electric power. Therefore according to the embodiment shown, the load detecting circuit 26 is provided to stop the oscillating operation of the inverter 15 in the case where such an improper load is placed on the top plate 1 or no load is placed thereon.

Figure 4:
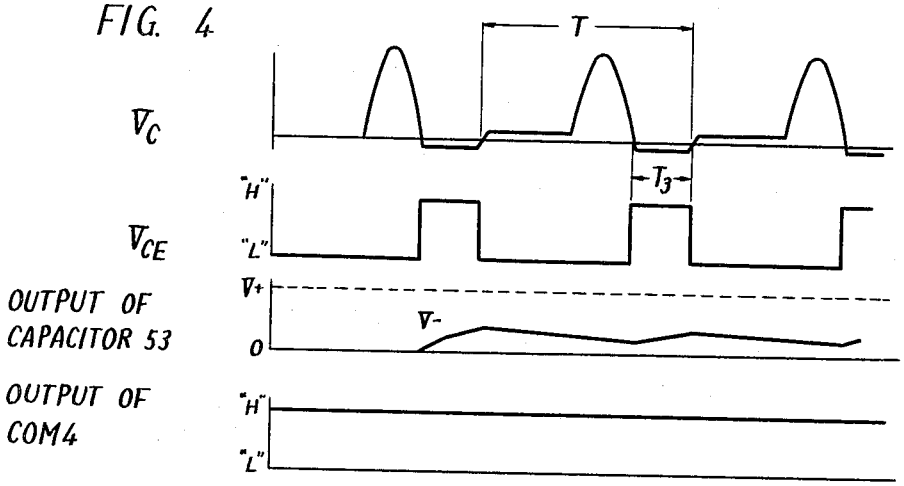
FIGS. 4 and 5 are graphs showing waveforms at various portions of the embodiment for explaining a load detecting operation.

Now referring to FIG. 4, an operation for detecting a proper load by the load detecting circuit 26 will be described. Assuming that a proper load such as a pan made of an iron group metal of such as iron, stainless steel or the like is placed on the top plate 1 as a load, the transistor 47 of the gate signal generator 23 is rendered non-conductive during the time period $T_3$ where the voltage $V_C$ of the resonance capacitor is negative. Accordingly, the collector voltage $V_{CE}$ of the transistor 47 is the high level. The high level voltage is applied to the integrating circuit implemented by the resistor 52 and the capacitor 53 included in the load detecting circuit 26. Accordingly, the output voltage of the capacitor 53 increases in accordance with the time constant. The integrated output voltage is applied to the minus input of the comparator COM4 as the signal V−. On the other hand, the reference level V+ obtained by dividing the source voltage $V_{CC}$ by means of the resistors 54, 55 and 56 as described previously is applied as the reference level of the comparator COM4. The capacitor 53 is charged during the above described period $T_3$ and is discharged during the periods $T_1$ and $T_2$ of the subsequent cycle. The output voltage of the capacitor 53 is compared with the reference level V+ by means of the comparator COM4. In the case of a proper load, the ratio of the period $T_3$ with respect to one cycle T ($=T_1+T_2+T_3$) of the oscillation of the inverter 15 is relatively small. Accordingly, the integrating voltage of the capacitor 53 is also a relatively small value and the level thereof is maintained in a relatively low level. Therefore, the output of the comparator COM4 remains at the high level. The high level output of the comparator COM4 opens the NAND gate NAND5, whereby generation of the gate signal from the gate signal generator 23 and thus driving of the inverter 15 is enabled.

Figure 5:
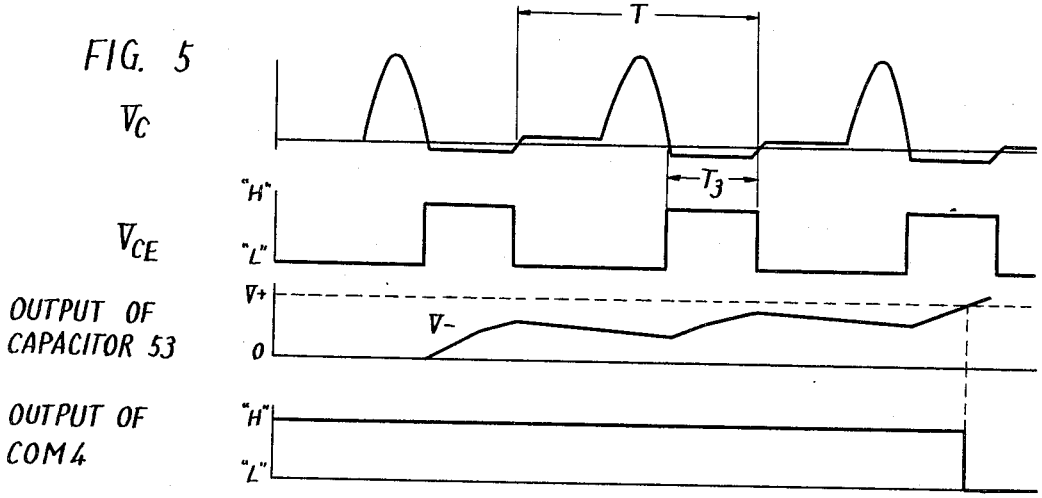

Now the case where too large a load or too small a load is placed on the top plate 1, or no load is placed on the top plate 1, will be described with reference to FIG. 5. In such load condition, the ratio of the conduction period $T_3$ of the flywheel diode 13 with respect to the oscillation cycle T increases. Accordingly, the charging time period of the capacitor 53 increases as compared with the previously described proper load condition and conversely the discharging time period decreases. As a result, the charging voltage of the capacitor 53 gradually increases for each period $T_3$ and ultimately reaches the reference level V+ of the comparator COM4. At that time the output of the comparator COM4 turns from the high level to the low level. Accordingly, the NAND gate NAND5 is closed. Therefore, the NAND gates NAND3 and NAND4 are also closed and the set input to the flip-flop 17 is blocked. The flip-flop 17 is reset responsive to the output of the comparator COM2 and the output of the NAND gate NAND1 included therein becomes the high level. When the output of the NAND gate NAND1 changes to the high level, the transistor 42 included in the inverter driver circuit 16 is rendered conductive and the gate of the switching element 12 is supplied with the reverse bias $-V_B$, with the result that the oscillation of the inverter 15 is stopped. Thus, an undesired heating operation in the case of a too-large load condition, a too-small load condition or a no-load condition is prevented through a detecting operation of the load detecting circuit 26.

In the case where the above described improper load is detected, the output of the NAND gate NAND1 is fixed to the high level, which is the same as the initial condition upon turning on of the power supply. Accordingly, after the lapse of the time period $\tau$ (approximately 0.4 seconds) since the clamp of the start signal generator 24 is released and the output of the NAND gate NAND1 becomes the high level, the start pulse is generated from the start signal generator 24. Although the start pulse restarts the inverter 15, insofar as the above described improper load condition continues, the same is detected again by the load detecting circuit 26 and the oscillation of the inverter 15 is again stopped. Thus, according to the embodiment shown, the starting and stopping of the inverter 15 are repeated, until the improper load condition is removed. Meanwhile, in such an improper load condition, the time period after the inverter 15 is started until such condition is detected by the load detecting circuit 26 and the inverter 15 is stopped would be several milliseconds. The above described time period is sufficiently shorter than the start signal generating cycle $\tau$ in the start signal generator 24 and accordingly the load will not be heated during that time period (several milliseconds). Thereafter, by bringing the above described improper load condition to a proper load condition, the inverter 15 reverts to a normal self-controlled oscillating operation, as described previously.

As described previously, the load detecting circuit of the embodiment shown detects the ratio of the conduction period $T_3$ of the flywheel diode 13 of the inverter 15 with respect to the oscillation cycle T, thereby determining the propriety of a load placed on the top plate 1 (FIG. 1) or whether a load has been placed thereon. The following table shows the ratio of the period ($T_3/T$) obtained as a result of experimentation with respect to various loads, together with the value of the charge voltage V− of the capacitor 53.

| | material of pan | T(μs) | $T_3$(μs) | $T_3/T$ | V−(V) |
|---|---|---|---|---|---|
| proper load | iron.stainless steel made pan | 29.0 | 5.5 | 0.19 | 1.814 |
| | iron made frypan | 36.0 | 7.5 | 0.21 | 1.730 |
| | cast pan | 31.0 | 7.5 | 0.24 | 1.785 |
| | stainless steel. copper bottomed frypan | 30.5 | 6.0 | 0.20 | 1.697 |
| improper load | alminum plate | 22.5 | 7.5 | 0.33 | 2.380 |
| | no-load | 39.0 | 14.5 | 0.37 | 2.404 |

As is clear from the foregoing table, in the case of a proper load mainly including iron and stainless steel, the values of the above described period ratio ($T_3/T$) would be in the range from approximately 0.2 to 0.3. On the other hand, in the case of, an improper load of such as aluminum or in case of no load, the above described ratio ($T_3/T$) becomes larger than 0.3. Such difference is also observed in the charge voltage V− of the capacitor 53, wherein in the case of a proper load the charge voltage V− is smaller than 2.0 V whereas in case of an improper load the charge voltage V− is higher than 2.0 V. Accordingly, the above described determination of a proper load or an improper load can be made by setting the reference level V+ of the comparator COM4 to be approximately 2.0 V. Meanwhile, as for a small load such as a knife, fork or the like, although the forgoing table fails to show, it has been observed from experimentation that approximately an intermediate value between that in the case of an aluminum plate and that of an iron or stainless steel made pan, and in this case the charge voltage V− of the capacitor 53 becomes higher than 2.0 V, with the result that the item is determined to be an improper load by the circuit 26.

Meanwhile, if and when the determination is made of an improper load condition and an oscillating operation of the inverter 15 is stopped, the transistor 47 included in the gate signal generator 23 is maintained in a conductive state and the charge voltage of the capacitor 53 is discharged through the transistor 47 which is conduction. Accordingly, the output of the comparator COM4 changes to the low level and then again becomes the high level after the lapse of a predetermined time period, so as to be ready for the detection of the next load condition.

Figure 6:
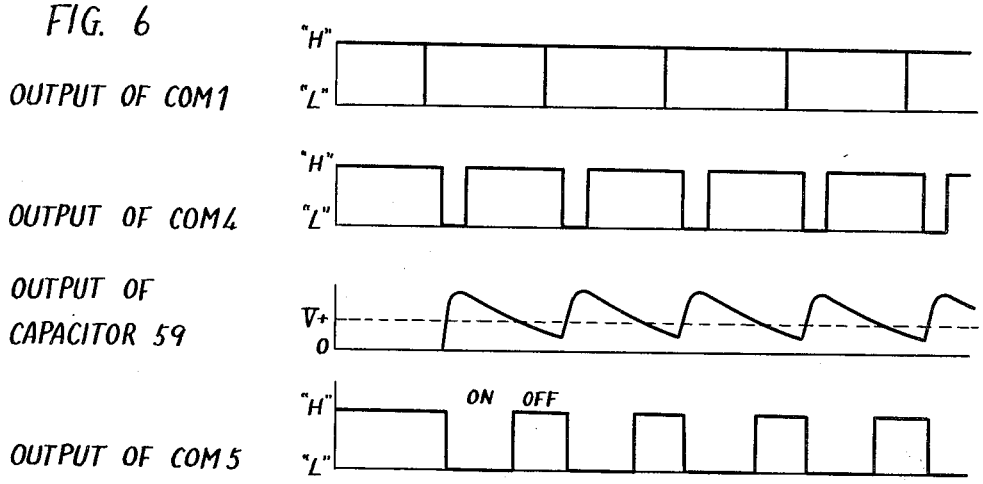
FIG. 6 is a graph showing waveforms at various portions of the embodiment for explaining an alarm raising operation.

III. Alarm Raising Operation (See FIG. 6.)

When an improper load condition is detected by the above described load detecting circuit 26, the oscillating operation of the inverter 15 is stopped, while, according to the embodiment shown, an alarm is also raised by the alarm generating circuit 27 to notify an operator of the same. The alarm generating circuit 27 is responsive to the output of the comparator COM4 included in the load detecting circuit 26 to notify an operator of the improper load condition and the stoppage of the heating operation. More specifically, if and when the output of the comparator COM4 turns from the high level to the low level, the low level signal is inverted by the inverter 57 to be a high level. The output of the inverter 57 is integrated by the integrating circuit implemented by the resistor 57 and the capacitor 59 and the output voltage from the integrating circuit is applied to the minus input of the comparator COM5. If and when the output voltage of the integrating circuit is higher than the reference level V+ obtained by dividing the source voltage $V_{CC}$ by means of the resistors 60 and 61, the output of the comparator COM5 changes to a low level. Accordingly, the low level signal obtained from the comparator COM5 drives the buzzer 62 to produce a pulsive sound. The detecting operation by the load detecting circuit 26 is made at each occurrence of the driving pulse obtained from the starting signal generator 24 and, therefore, when the improper load condition continues, the output of the comparator COM5 changes to the low level at intervals of 0.4 seconds ($\tau$), whereby the buzzer 62 is energized to produce a sound in synchronism therewith. By selecting the period of occurrence of a sound from the buzzer 62 to be shorter than 0.4 seconds, say 0.1 second, a sound from the buzzer 62 becomes an intermittent alarm sound at intervals of 0.4 seconds.

IV. Output Adjusting Operation (See FIGS. 7A and 7B.)

Figure 7A:
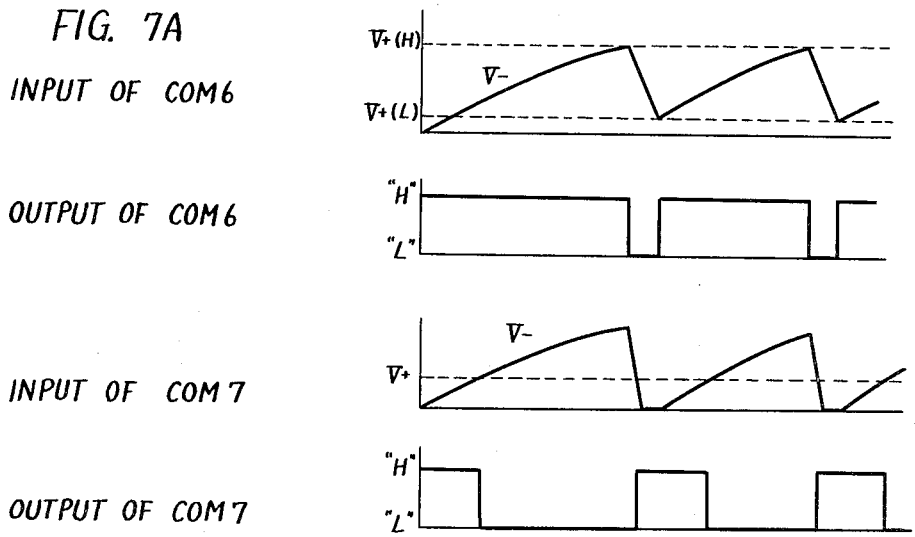
FIGS. 7A and 7B are graphs showing waveforms at various portions of the embodiment for explaining an output adjusting operation.
Figure 7B:
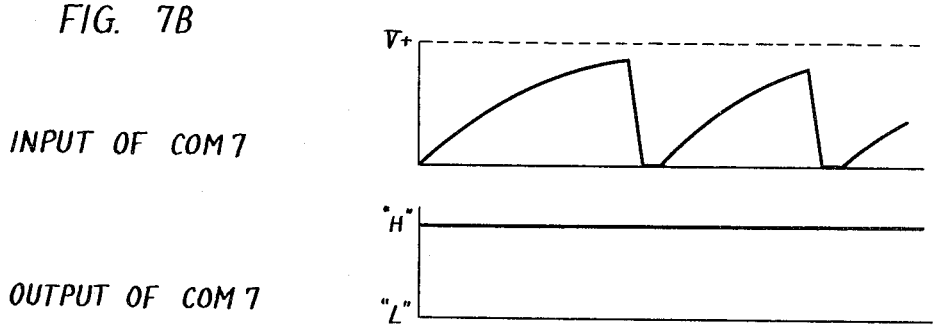

Adjustment of the output power is made by operating the adjusting knob 3 (FIG. 1) to move the sliding contact of the variable resistor 63 included in the output adjusting circuit 28. The output adjusting circuit 28 of the embodiment shown is adapted such that one cycle is selected to be approximately 10 seconds and the ratio of the oscillation period and the stop period, i.e. the duty cycle of the inverter 15 is changed, whereby the output power is changed. More specifically, the integrating circuit connected to the minus input of the comparator COM6 and implemented with the resistor 66 and the capacitor 67 is structured such that the time constant thereof may be associated with the above described "ten second". The reference level V+ of the comparator COM6 is selected to be the voltage obtained by dividing the source voltage $V_{CC}$ by means of the resistors 64 and 65. The output of the comparator COM6 is applied through the diode 68 to the integrating circuit implemented by the resistor 69 and the capacitor 70. The integrated output of the integrating curcuit is applied to the minus input of the comparator COM7. The reference level V+ of the comparator COM7 is selected to be the voltage obtained by dividing the source voltage $V_{CC}$ by means of the above described variable resistor 63 and the resistor 71. Accordingly, the reference level V+ of the comparator COM7 can be arbitrarily set by operating the output adjusting knob 3 to move the sliding contact of the variable resistor 63. If and when the output voltage of the integrating circuit exceeds the reference level V+ thus established, the output of the comparator COM7 turns from the high level to the low level. Accordingly, the NAND gate NAND1 is closed and the set input to the flip-flop 17 is blocked. The flip-flop 17 is reset responsive to the output of the comparator COM2 and the output of the NAND gate NAND1 included therein is turned to the high level. Therefore, the transistor 42 of the inverter driver circuit 16 is brought in a conductive state and the switching element 12 included in the inverter 15 is rendered non-conductive, whereby the oscillation of the inverter 15 is stopped. More specifically, the oscillation of the inverter 15 is enabled only during the period when the output of the comparator COM7 is the high level. FIG. 7A shows a case where the resistance value of the variable resistor 63 is selected to be minimal, i.e. the output power is selected to be minimal. Conversely, FIG. 7B shows a case where the resistance value of the variable resistor 63 is selected to be maximum, i.e. the output power is selected to be maximum. In the case of FIG. 7A, a heating operation is made during approximately 1.7 seconds out of the above described cycle of 10 seconds, while the apparatus is in a heating stopped state during the remaining period. In the case of FIG. 7B, the minus input of the comparator COM7 will not reach the reference level V+ and the output thereof remains the high level. Accordingly, in such a case, the inverter 15 is enabled to make oscillation continuously without a rest period. Thus, the output power can be adjusted arbitrarily in the range of approximately 200 to 1200 W.

Figure 8:
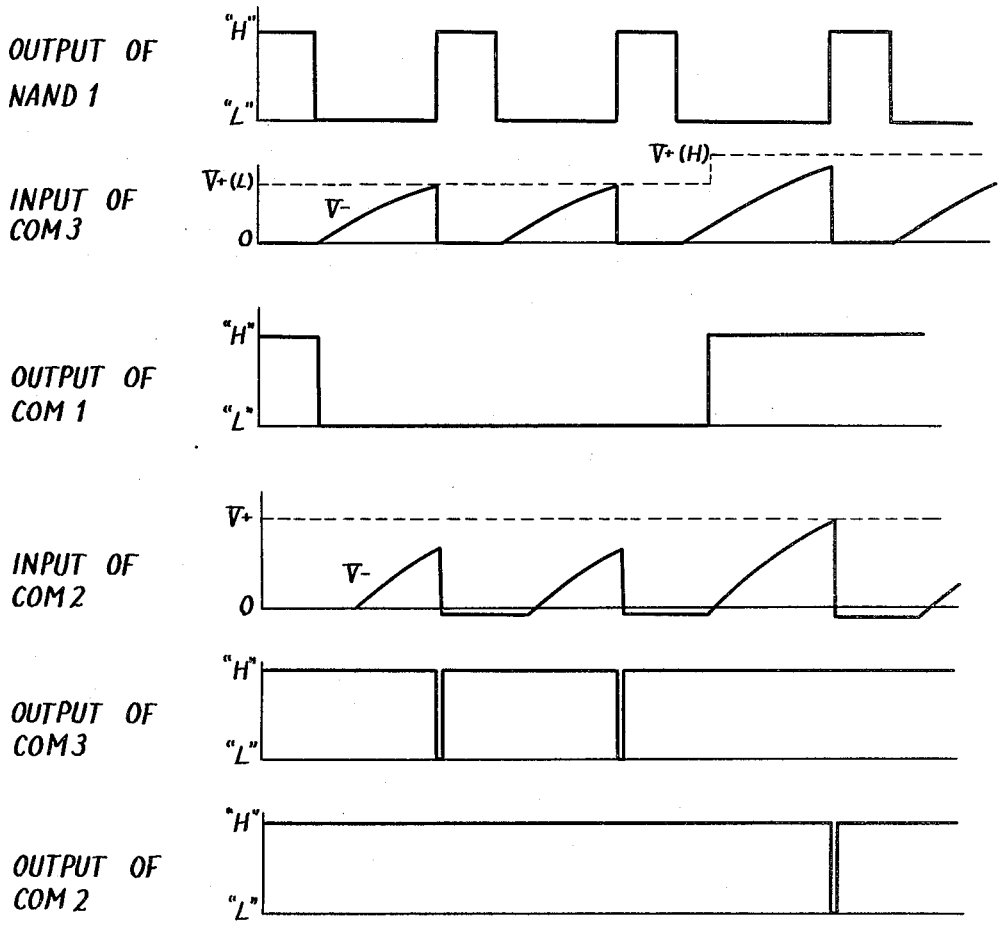
FIG. 8 is a graph showing waveforms at various portions of the embodiment for explaining an operation of a protecting circuit.

V. Protecting Circuit Operation (See FIG. 8.)

In the embodiment shown, as described previously, the load current $i_L$ flowing through the switching element 12 included in the inverter 15 is detected by the current transformer CT and control is made so that the value thereof may not exceed a predetermined value. However, depending on the magnitude and the timing of the rise of the load current at the start or in the course of operation, the magnetized state of the ferrite magnet included in the current transformer CT changes, with the result that it could happen that the detected voltage $V_{CT}$ in proportion to the load current $i_L$ is not necessarily obtained from the current transformer CT. In such a case, the gate signal generator 23 is not operable and the conduction period of the switching element 12 becomes abnormally prolonged, so that an overcurrent flows through the element 12, thereby to damage the element 12. Therefore, according to the embodiment shown, the protecting circuit 25 is provided for the purpose of protecting the switching element 12 from such accident.

Even if a proper voltage (in proportion to the load current $i_L$) is not detected by the current transformer CT, whereby a current continues to flow through the switching element 12, the protecting circuit 25 forcibly renders the switching element 12 unconditionally non-conductive after the lapse of a predetermined time period. More specifically, if and when the start signal generator 24 becomes operable and the output of the comparator COM1 included therein turns to the low level, the low level signal is applied through the resistor 72 and the diode 73 to the input terminal of the reference level V+ of the comparator COM3. The input terminal thereof has been provided with a voltage obtained by dividing the source voltage $V_{CC}$ by means of the resistors 74 and 75 as the reference level V+. On the other hand, since the output of the NAND gate NAND1 of the flip-flop 17 changes to the low level responsive to the start pulse, the transistor 76 is brought to a non-conductive state. Therefore, the charge voltage of the capacitor 77 gradually increases. On the other hand, the minus input of the comparator COM3 is supplied with the output of the integrating circuit implemented by the resistor 78 and the capacitor 77 and the output of the comparator COM3 turns to the low level if and when the output voltage of the integrating circuit reaches the reference level V+. Accordingly, the flip-flop 17 is reset and the output of the NAND gate NAND1 changes to the high level. Therefore, the inverter driver circuit 16 renders the switching element 12 included in the inverter 15, non-conductive. Thereafter, the high level output of the NAND gate NAND1 renders the transistor 76 again conductive, so that the charge voltage in the capacitor 77 is discharged therethrough, whereby the output of the comparator COM3 immediately returns to the high level. The output terminal of the protecting circuit 25 and the output terminal of the gate signal generator 23 are connected in a wired OR fashion and the output thereof is applied to an input of the NAND gate NAND1. Therefore, even if no signal for rendering the switching element 12 non-conductive is obtained from the gate signal generator 23 for some reason, such as due to the current transformer CT, the switching element 12 is forcibly rendered non-conductive by the operation of the propecting circuit 25, whereby the osicillation of the inverter 15 is stopped.

The protecting circuit 25 is structured such that if and when the start signal generator 24 is first operated the same becomes operable at a low input for a predetermined time period, whence the same becomes operable at a normal input. More specifically, the reference level V+ of the comparator COM3 assumes two different levels of, i.e. the low level V+(L) and the high level V+(H). The high level V+(H) corresponds to the occasion in which the start signal generator 24 has been stopped and COM1 has a high level output, whereas the low level V+(L) corresponds to the occasion wherein the start signal generator 24 has been enabled. Such two different levels are attained by applying the output of the comparator COM1 through the resistor 72 and the diode 73 to the input terminal of the reference level V+ of the comparator COM3. If and when the gate signal generator 23 is not operated for some reason, such as due to the characteristic of the current transformer CT as described previously, the oscillating operation is initiated by the inverter 15 in response to the pulse signal obtained from the protecting circuit 25. If and when the load is an improper load such as a copper pan at that time, an overcurrent flows through the switching element 12, with a resultant fear that the element 12 will be damaged. On the other hand, in the case of no-load, an overvoltage is applied to the switching element 12, again with a resultant fear that the switching element 12 will be damaged in this case as well. Therefore, according to the embodiment shown, protection of the switching element 12 is achieved such that immediately after the turning on of the power supply the frequency of the output pulse of the protecting circuit 25 is raised to say 35 kHz, whereby the input to the load is decreased, and the load current $i_L$ flowing through the switching element 12, and thus the voltage applied thereto, is decreased or lowered. On the other hand, if and when the propriety or impropriety of the load is also determined simultaneously by means of the load detecting circuit 26 at the low input occasion, and if the determination is made that there is an improper load condition, immediately the oscillation of the inverter 15 is stopped. In such a case, the time period from the start of the inverter, due to the output of the protecting circuit 25, up to the stopping of it would be several milliseconds, whereas the period for the starting pulse has been selected to be relatively long as long, as approximately 20 milliseconds. Therefore the timing for stopping the above described oscillation can be brought sufficiently within the high frequency oscillation period due to the protecting circuit 25. Accordingly, the load detecting operation is expanded up to the low frequency oscillating period and an overcurrent is prevented from flowing through the switching element 12 on the occasion of an improper load condition.

Furthermore, the protecting circuit 25 restricts the lower limit of the oscillation frequency of the inverter 15, thereby preventing the oscillation frequency from decreasing toward an audible frequency region. For example, according to the embodiment shown, without the protecting circuit 25, the oscillation frequency of the inverter 15 would be an audible frequency of say several tens of kHz in the case of a start from a no-load state, whereby noise could be caused. However, by making the oscillation at a high frequency, as high as 35 kHz, by the above described protecting circuit 25, such noise can be prevented from being generated. Furthermore, even in the case where a load of such as 18-8 stainless steel, copper or the like exhibiting a large equivalent inductance L and a large equivalent resistance R of the induction coil 11 is used, without the protecting circuit 25, the oscillation frequency of the inverter 15 decreases to an audible frequency lower than 20 kHz. However, in this case as well, the oscillation frequency is prevented from decreasing by means of the protecting circuit 25.

Figure 9:
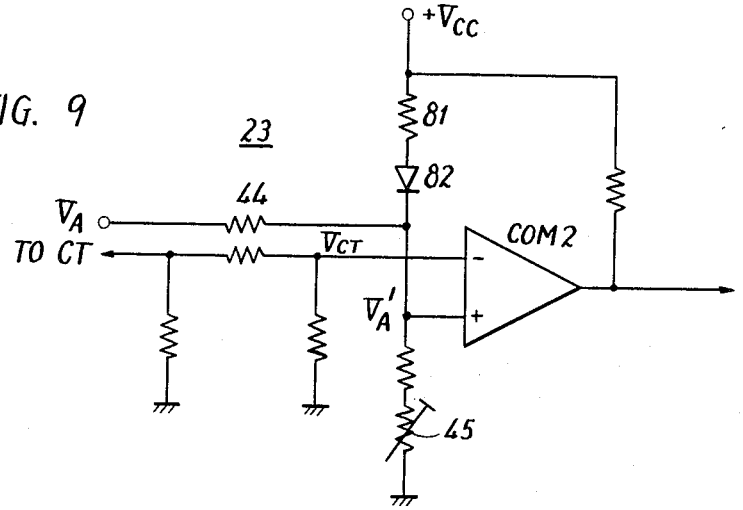
FIG. 9 is a schematic diagram of a major portion of another preferred embodiment of a gate signal generating circuit.
Figure 10:
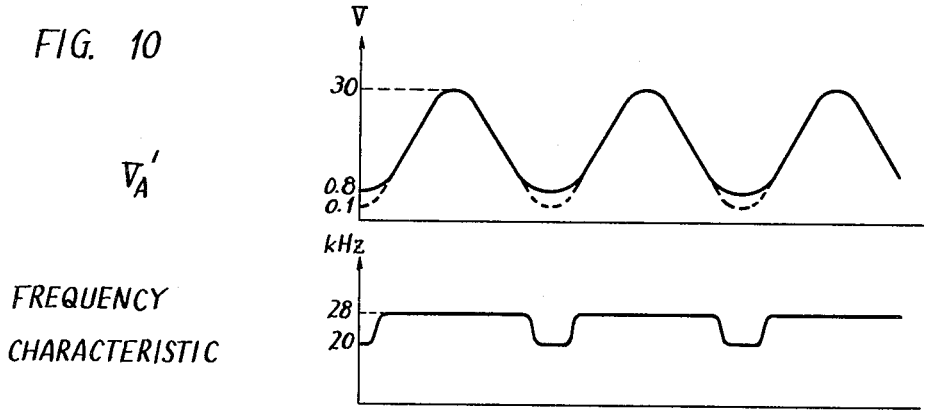
FIGS. 10 and 11 are graphs showing waveforms at various portions of the FIG. 9 embodiment for explaining an operation and advantage thereof.
Figure 11:
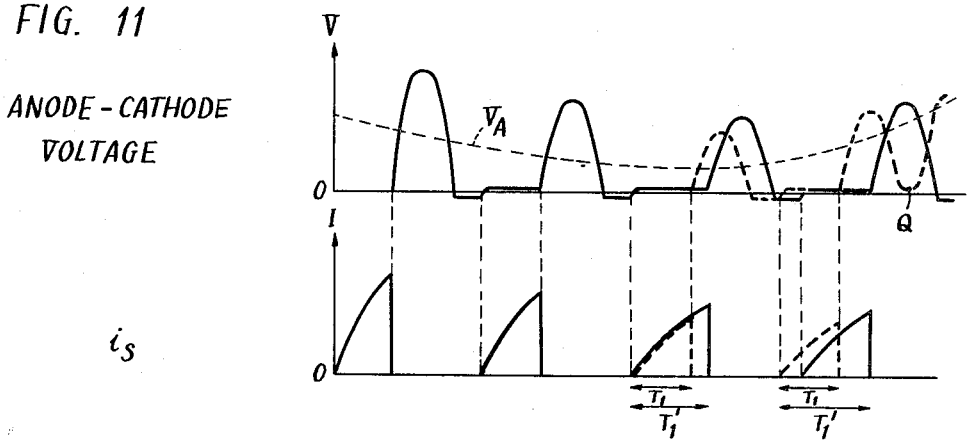

FIG. 9 is a schematic diagram of another preferred embodiment of the gate signal generator 23. As compared with the FIG. 2 embodiment, the embodiment under discussion is characterized in that the direct current voltage $V_{CC}$ and the reference level V+ of the comparator COM2 are connected by means of a series connection of the resistor 81 and the diode 82. With reference to FIGS. 10 and 11, the operation of the FIG. 9 embodiment will be described in the following.

FIG. 10 shows a waveform of the voltage $V_{A'}$, being applied to the reference level V+ of the comparator COM2. The dotted line curve shows a case of the FIG. 2 embodiment, without the resistor 81 and the diode 82. The voltage $V_{A'}$ becomes a ripple current associated therewith in accordance with the source voltage $V_A$, which changes between the maximum 3.0 V to the minimum 0.8 V. The resistor 81 and the diode 82 are effective at the valley or bottom portion of the voltage $V_{A'}$, so that the direct current voltage (that obtained by dividing the current voltage $V_{CC}$ by means of the resistors) is superimposed on the voltage $V_{A'}$ and the resultant voltage $V_{A'}$ decreases in association with the sources voltage $V_A$. The voltage $V_{A'}$ is relatively high during the period other than the bottom or the valley and the addition of such direct current voltage is apparently not made. Meanwhile, as seen from FIG. 10, in the case when the resistors 81 and 82 are not provided, the voltage $V_{A'}$ decreases down to approximately 0.1 V, as shown by the dotted line.

FIG. 11 shows the voltage between the anode and cathode of the switching element 12 and the current $i_S$ of the switching element 12. The amplitude of the oscillation of the inverter 15 changes in association with the magnitude of the ripple current source voltage $V_A$ shown by the dotted line in FIG. 11. The maximum of the output voltage of the oscillation would be approximately 670 V and the minimum thereof would be approximately 60 V. In association with the oscillation voltage, the current $i_S$ of the switching element 12 also becomes approximately 50 A for maximum to approximately 6 A for the minimum. Since the current flowing through the switching element 12 and the voltage being applied thereto thus change, it could happen that the lower limit of the resonance voltage of the inverter 15 does not become smaller than 0 V, as at the Q point shown by the dotted line waveform in FIG. 11, at the beginning of a change of the ripple current waveform $V_A$ from the minimum state (the bottom) upward. Then, according to the previously described FIG. 2 embodiment, the gate signal generator 23 does not operate, with the result that it could happen that the inverter 15 can not maintain the oscillation. However, according to the embodiment shown, the direct current voltage is applied to the voltage $V_{A'}$, through the resistor 81 and the diode 82 in the vicinity of the bottom of the ripple current waveform $V_A$ and therefore the conduction period of the switching element 12 is prolonged. Accordingly, the oscillation frequency of the inverter 15 can be decreased and by increasing the amplitude of the voltage between the anode and cathode of the switching element 12, in which case the resonance voltage becomes lower than 0 V even in the upward increasing period of the ripple current waveform $V_A$ as shown by the solid line in FIG. 11. Accordingly, the above described problem that the oscillation can not be maintained can be eliminated. Meanwhile, the current waveform of the switching element 12 shown in FIG. 11, the conduction period of the switching element 12 of the FIG. 9 embodiment is shown by $T_{1'}$ and the period of the conventional one is shown by $T_1$.

FIG. 10 shows a frequency characteristic in the case where the conduction period of the switching element 12 is prolonged in the vicinity of the bottom of the ripple current source voltage $V_A$. FIG. 10 shows a case where a stainless steel pan is used as a load, wherein the inverter 15 oscillates normally at a frequency of approximately 28 kHz, which decreases to approximately 20 kHz in the vicinity of the bottom of the source voltage. Meanwhile, a decrease of the lower limit of the oscillation frequency to a frequency lower than 20 kHz is not preferred from the practical stand point, inasmuch as an audible noise is caused, as described previously.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An induction heating cooking apparatus, comprising:

power supply means having a particular polarity output voltage, self-controlled inverter means energized by said power supply means, said self-controlled inverter means comprising an induction coil and a switching element connected in series with said power supply means, a resonance capacitor connected in parallel with said switching element, and a one directional current flow device connected in parallel with said switching element in a reversed polarity with respect to the power supply voltage, start signal generating means responsive to a turning on of said power supply means for generating a start signal for starting said self-controlled inverter means, current level detecting means for detecting the level of current flowing through said switching element after said self-controlled inverter means is started, first control means for controlling said switching element so as to put it into a non-conductive state when the current level detected by said current level detecting means reaches a predetermined current value, voltage level detecting means for detecting the level of the terminal voltage of said resonance capacitor, and second control means for applying a voltage to said switching element tending to put it into a conductive state when the voltage level detected by said voltage level detecting means becomes smaller than a predetermined value, said first and second control means causing said inverter means to oscillate at a predetermined frequency.

2. An induction heating cooking apparatus in accordance with claim 1, wherein said current level detecting means comprises voltage signal withdrawing means coupled to a path of the current flowing through said switching element for withdrawing a voltage signal having a level associated with said current level, and said first control means comprises gate reference level generating means for generating a predetermined voltage level associated with said predetermined current level as a gate reference level, and gate comparator means for comparing said gate reference level from said gate reference level generating means and said voltage signal from said voltage signal withdrawing means for providing a signal for controlling said switching element so as to put it into a non-conductive state when said voltage signal reaches said gate reference level.

3. An induction heating cooking apparatus in accordance with claim 2, wherein said voltage withdrawing means comprises a current transformer coupled to a current path between said switching element and said power supply means.

4. An induction heating cooking apparatus in accordance with claim 2, wherein said gate reference level generating means comprises voltage level varying means for varying said predetermined voltage level.

5. An induction heating cooking apparatus in accordance with claim 4, wherein said power supply means comprises a ripple current voltage source means, and said voltage level varying means is adapted to generate a voltage of a level associated with a ripple current voltage obtained from said ripple current voltage source means.

6. An induction heating cooking apparatus in accordance with claim 5, wherein said voltage level varying means comprises voltage dividing means for dividing said ripple current voltage for generating the voltage used as said gate reference level.

7. An induction heating cooking apparatus in accordance with claim 6, wherein said voltage dividing means comprises voltage division ratio changing means for changing the voltage division ratio.

8. An induction heating cooking apparatus in accordance with claim 7, wherein said voltage division ratio changing means comprises a variable resistor.

9. An induction heating cooking apparatus in accordance with claim 6, which further comprises compensating means for compensating the voltage output from said voltage dividing means when said ripple current voltage from said ripple current voltage source means reaches a predetermined condition, so that the ripple current voltage does not fall below a predetermined level.

10. An induction heating cooking apparatus in accordance with claim 9, which further comprises direct current voltage generating means for generating a direct current voltage of a predetermined level associated with said ripple current voltage from said ripple current voltage source means, and wherein said compensating means comprises superimposing means for superimposing the direct current voltage from said direct current voltage generating means on the output of said voltage dividing means, the direct current voltage being sufficient to keep the ripple current voltage from falling to a value that would result in oscillations of the inverter means in the audible range.

11. An induction heating cooking apparatus in accordance with claim 1, which further comprises third control means for controlling said switching element so as to put it into a non-conductive state when a current flows through said switching element continuously for more than a predetermined time period.

12. An induction heating cooking apparatus in accordance with claim 11, wherein said third control means comprises control time constant circuit means for generating an output signal related to the passage of time and being operable responsive to the conduction state of said switching element and said directional device, control reference level generating means for generating a predetermined control reference level related to said predetermined time, and control comparator means for providing a signal for controlling said switching element so as to put it into a non-conduction state if and when the output of said control time constant circuit means reaches the predetermined control reference level from said control reference level generating means, said control time constant circuit and control reference level being such that said predetermined time has a value so that the frequency of oscillation of the inverter means does not fall into the audible range.

13. An induction heating cooking apparatus in accordance with claim 12, wherein said control time constant circuit means comprises a capacitor, and which further comprises a discharging path connected to said capacitor, and enabling means for enabling said discharging path if and when said switching element is controlled so as to put it into a non-conduction state by means of said first control means.

14. An induction heating cooking apparatus in accordance with claim 13, wherein:

said start signal generating means comprises start time constant circuit means for generating an output signal related to the passage of time and being operable responsive to the turning on of said power supply means, start comparator means for providing said start signal for a predetermined time period if and when the output voltage of said start time constant circuit means reaches a predetermined start reference level, and said control reference level generating means comprises means for receiving the output of said start comparator means as a portion of said control reference level.

15. An induction heating cooking apparatus in accordance with claim 14, which further comprises direct current voltage generating means for generating a direct current voltage of a predetermined level in association with said power supply voltage, and wherein said control reference level generating means comprises voltage dividing means for dividing the direct current voltage from said direct current voltage generating means, and said means for receiving the output of said start comparator means as a portion of said reference level comprises superimposing means for superimposing the output of said voltage dividing means on the output of said start comparator means.

16. An induction heating cooking apparatus in accordance with claim 1, wherein a load being heated is placed in the vicinity of said induction coil means, and which further comprises ratio detecting means for detecting the ratio of the conduction period of said directional element with respect to the oscillation cycle of said self-controlled inverter, and load condition determining means responsive to the output of said ratio detecting means for determining the load condition.

17. An induction heating cooking apparatus in accordance with claim 16, which further comprises oscillation stopping means responsive to the output of said load condition determining means for stopping the oscillation of said self-controlled inverter means.

18. An induction heating cooking apparatus in accordance with claim 17, which further comprises oscillation stopped state detecting means for detecting an oscillation stopped state established by said oscillation stopping means, and enabling means responsive to the output of said oscillation stopped state detecting means for enabling said start signal generating means.

19. An induction heating cooking apparatus in accordance with claim 16, which further comprises notifying means responsive to the output of said load condition determining means for indicating the load condition.

20. An induction heating cooking apparatus in accordance with claim 16, wherein said ratio detection means comprises load time constant circuit means for generating an output voltage related to the passage of time and being charged during the conduction period of said directional element and being discharged during the remaining period of each oscillation until said directional element is again rendered conductive, and said load condition determining means comprises load reference level generating means for generating a load reference level, and load comparator means for comparing said load reference level and the output voltage from said load time constant circuit means for providing a signal representing an improper load condition if and when said output voltage reaches said reference level.

21. An induction heating cooking apparatus in accordance with claim 20, wherein said directional element is rendered conductive if and when the terminal voltage of said resonance capacitor becomes lower than a predetermined value in the oscillation cycle of said self-controlled inverter and otherwise is rendered non-conductive, and said load time constant circuit means comprises a capacitor, and charging/discharging means responsive to the terminal voltage of said resonance capacitor for charging and discharging said capacitor.

22. An induction heating cooking apparatus in accordance with claim 21, wherein said charging/discharging means comprises a transistor connected in parallel with said capacitor and being controlled by the terminal voltage of said resonance capacitor.

23. An induction heating cooking apparatus in accordance with claim 1, which further comprises predetermined period defining means for defining a predetermined period, and adjusting means for adjusting the duty cycle of the oscillation period and the non-oscillation period of said self-controlled inverter means in said predetermined period.

24. An induction heating cooking apparatus in accordance with claim 23, wherein said adjusting means comprises output time constant circuit means for generating an output related to the passage of time, output comparator circuit means receiving the output of said time constant circuit means as one input thereto, output reference level means for providing an output reference level to said comparator circuit means, and output reference level changing means for changing said output reference level.

25. An induction heating cooking apparatus in accordance with claim 24, wherein said output reference level changing means comprises a variable resistor.

26. An induction heating cooking apparatus, comprising:

power supply means having a particular polarity output voltage, self-controlled inverter means energized by said power supply means, said self-controlled inverter means comprising an induction coil and a switching element connected in series with said power supply means, a resonance capacitor connected in parallel with said switching element, and a one directional current flow element connected in parallel with said switching element in a reversed polarity with respect to the power supply voltage, start signal generating means responsive at least to the turning on of said power supply means for generating a start signal for starting said self-controlled inverter means, switching element control means responsive to the start signal from said start signal generating means for controlling said switching element to be conductive or non-conductive based on the current or voltage at a given point of said self-controlled inverter means after said self-controlled inverter means is started, said switching element control means causing said inverter means to oscillate at a particular high frequency, said induction coil generating a high frequency alternating magnetic field as a function of the oscillation of said self-controlled inverter means, whereby a load placed in the vicinity of said induction coil is induction heated, ratio detecting means for detecting the ratio of the conduction period of said directional element with respect to the oscillation cycle of said self-controlled inverter means, and load condition detecting means responsive to the output of said ratio detecting means for detecting said load condition.

27. An induction heating cooking apparatus in accordance with claim 26, which further comprises oscillation stopping means responsive to the output of said load condition determining means for stopping the oscillation of said self-controlled inverter means.

28. An induction heating cooking apparatus in accordance with claim 27, which further comprises
oscillation stopped state detecting means for detecting an oscillation stopped state established by said oscillation stopping means, and
enabling means responsive to the output of said oscillation stopped state detecting means for enabling said start signal generating means.

29. An induction heating cooking apparatus in accordance with claim 26, which further comprises
notifying means responsive to the output of said load condition determining means for indicating the load condition.

30. An induction heating cooking apparatus in accordance with claim 26, wherein
said ratio detecting means comprises load time constant circuit means for generating an output voltage related to the passage of time and being charged during the conduction period of said directional element and being discharged during the remaining period of each oscillation of the inverter means until said directional element is again rendered conductive, and
said load condition determining means comprises
load reference level generating means for generating a load reference level, and
load comparator means for comparing said load reference level and the output voltage from said load time constant circuit means for providing a signal representing an improper load condition if and when said output voltage reaches said load reference level.

31. An induction heating cooking apparatus in accordance with claim 30, wherein
said directional element is rendered conductive if and when the terminal voltage of said resonance capacitor becomes lower than a predetermined value in the oscillation cycle of said self-controlled inverter and otherwise is rendered non-conductive, and
said load time constant circuit means comprises
a capacitor, and
charging/discharging means responsive to the terminal voltage of said resonance capacitor for charging and discharging said capacitor.

32. An induction heating cooking apparatus in accordance with claim 31, wherein
said charging/discharging means comprises a transistor connected in parallel with said capacitor and being controlled by the terminal voltage of said resonance capacitor.

33. An induction heating cooking apparatus in accordance with claim 26, which further comprises
predetermined period defining means for defining a predetermined period, and
adjusting means for adjusting the duty cycle of the oscillation period and the non-oscillation period of said self-controlled inverter means in said predetermined period.

34. An induction heating cooking apparatus in accordance with claim 33, wherein
said adjusting means comprises
output time constant circuit means for generating an output related to the passage of time,
output comparator circuit means receiving the output of said output time constant circuit means as one input thereto,
output reference level means for providing an output reference level to another input of said output comparator circuit means, and
output reference level changing means for changing said output reference level.

35. An induction heating cooking apparatus in accordance with claim 34, wherein
said output reference level changing means comprises a variable resistor.

36. An induction heating cooking apparatus, comprising:
power supply means having a particular polarity of output voltage,
self-controlled inverter means energized by said power supply means,
said self-controlled inverter means comprising
an induction coil and a switching element connected in series with said power supply means,
a resonance capacitor connected in parallel with said switching element, and
a unidirectional current flow device connected in parallel with said switching element in a reversed polarity with respect to the output voltage of the power supply means,
start signal generating means responsive to the turning on of said power supply means for generating a start signal for starting said self-controlled inverter means,
current level detecting means for detecting the level of a current flowing through said switching element after said self-controlled inverter means is started, said current level detecting means includes a current transformer coupled to a current path of the current flowing through said switching element for withdrawing a voltage signal having a level associated with said current level,
first control means for controlling said switching element so it is put into a non-conductive state when the current level detected by said current level detecting means reaches a predetermined value, said first control means includes
reference level generating means for generating a predetermined voltage level associated with said predetermined current level as a current reference level, and
comparator means for comparing said current reference level from said reference level generating means and said voltage signal from said voltage signal withdrawing means for providing a signal for controlling said switching element so as to make it non-conductive when said voltage signal reaches said reference level,
voltage level detecting means for detecting the level of the terminal voltage of said resonance capacitor, and
second control means for applying a signal to said switching element tending to place it into a conductive state when the voltage level detected by said voltage level detecting means becomes smaller than a predetermined value.

37. An induction heating cooking apparatus, comprising:
power supply means having a particular polarity of output voltage, said power supply means including ripple current voltage source means,
self-controlled inverter means energized by said power supply means,
said self-controlled inverter means comprising an induction coil and a switching element connected in series with said power supply means, a resonance capacitor connected in parallel with said switching element, and a unidirectional current flow device connected in parallel with said switching element in a reversed polarity with respect to the output voltage of the power supply means, start signal generating means responsive to the turning on of said power supply means for generating a start signal for starting said self controlled inverter means, current level detecting means for detecting the level of a current flowing through said switching element after said self-controlled inverter means is started, said current level detecting means includes voltage signal withdrawing means coupled to a path for the current flowing through said switching element for withdrawing a voltage signal having a level associated with said current level, first control means for controlling said switching element so it is put into a non-conductive state when the current level detected by said current level detecting means reaches a predetermined value, said first control means includes reference level generating means for generating a predetermined voltage level associated with said predetermined current level, said reference level generating means having a voltage level varying means in the form of voltage dividing means for generating and varying said predetermined voltage level by dividing the ripple current voltage obtained from said ripple current voltage source means, and compensating means for compensating the voltage output from said voltage dividing means when said ripple current voltage from said ripple current voltage source means reaches a predetermined level, comparator means for comparing said predetermined voltage level and said voltage signal from said voltage signal withdrawing means for providing a signal for controlling said switching element so as to make it non-conductive when said voltage signal reaches said reference level, voltage level detecting means for detecting the level of the terminal voltage of said resonance capacitor, and second control means for applying a signal to said switching element tending to place it into a conductive state when the voltage level detected by said voltage level detecting means becomes smaller than a predetermined value.

38. An induction heating cooking apparatus, comprising:

power supply means having a particular polarity of output voltage, said power supply means including ripple current voltage source means, direct current voltage generating means for generating a direct current voltage having a level larger than the minimum value of the ripple current voltage obtained from said ripple current voltage source means, direct current voltage superimposing means for superimposing the direct current voltage from said the direct current voltage generating means on said ripple current voltage, self-controlled inverter means energized by said power supply means, said self-controlled inverter means comprising an induction coil and a switching element connected in series with said power supply means, a resonance capacitor connected in parallel with said switching element, and a unidirectional current flow device connected in parallel with said switching element in a reversed polarity with respect to the output voltage of the power supply means, start signal generating means responsive to the turning on of said power supply means for generating a start signal for starting said self-controlled inverter means, current level detecting means for detecting the level of current flowing through said switching element after said self-controlled inverter means is started, first control means for controlling said switching element so as to put it in a non-conductive state when the current level detected by said current level detecting means reaches a predetermined value, voltage level detecting means for detecting the level of the terminal voltage of said resonance capacitor, and second control means for applying a signal to said switching element tending to place it into a conductive state when the voltage level detected by said voltage level detecting means becomes smaller than a predetermined value.

* * * * *